US010626670B2

(12) United States Patent
Cheng

(10) Patent No.: US 10,626,670 B2
(45) Date of Patent: Apr. 21, 2020

(54) CONTROL APPARATUS FOR A WINDOW BLIND

(71) Applicant: Ching-Hsiang Cheng, Tainan (TW)

(72) Inventor: Ching-Hsiang Cheng, Tainan (TW)

( * ) Notice: Subject to any disclaimer, the term of this patent is extended or adjusted under 35 U.S.C. 154(b) by 230 days.

(21) Appl. No.: 15/599,630

(22) Filed: May 19, 2017

(65) Prior Publication Data

US 2018/0179816 A1 Jun. 28, 2018

(30) Foreign Application Priority Data

Dec. 26, 2016 (TW) ..... 105143151 A

(51) Int. Cl.

| | |
|---|---|
| ***E06B 9/326*** | (2006.01) |
| ***E06B 9/82*** | (2006.01) |
| ***E06B 9/78*** | (2006.01) |
| ***E06B 9/50*** | (2006.01) |

(52) U.S. Cl.

CPC ..... *E06B 9/82* (2013.01); *E06B 9/326* (2013.01); *E06B 9/50* (2013.01); *E06B 9/78* (2013.01); *E06B 2009/3265* (2013.01); *E06B 2009/785* (2013.01)

(58) Field of Classification Search

CPC ..... E06B 9/78; E06B 2009/785; E06B 2009/3265; E06B 9/50; E06B 9/322; E06B 2009/1743; E06B 2009/1746

See application file for complete search history.

(56) References Cited

U.S. PATENT DOCUMENTS

| | | | | |
|---|---|---|---|---|
| 6,749,000 | B2 * | 6/2004 | Bohlen | E06B 9/322 160/178.1 R |
| 8,336,598 | B1 * | 12/2012 | Chang | E06B 9/56 160/177 V |
| 9,540,872 | B2 * | 1/2017 | Gramsch | F16H 19/06 |
| 9,574,397 | B1 * | 2/2017 | Cheng | E06B 9/44 |
| 10,113,594 | B2 * | 10/2018 | Cheng | E06B 9/326 |
| 2012/0017399 | A1 * | 1/2012 | Huang | E06B 9/326 24/115 F |

* cited by examiner

*Primary Examiner* — Katherine W Mitchell
*Assistant Examiner* — Jeremy C Ramsey
(74) *Attorney, Agent, or Firm* — McClure, Qualey & Rodack, LLP

(57) ABSTRACT

A control apparatus for controlling rotation of a shaft about an axis includes a roller releasably and rotatably connected to a rear housing mount of a housing that is firmly secured to a wall, an operating cord looped on the roller, a front coupling member co-rotatably coupled with the shaft, and a rear coupling member releasably connected to the roller by a rearward resilient force of a resilient member and movable and non-rotatable relative to the front coupling member. The roller is moved, upon an excess downward pulling force, to a releasing position, where the rear coupling member is moved forwardly to release connection with the roller so as to permit removal of the roller from the housing.

5 Claims, 11 Drawing Sheets

CONTROL APPARATUS FOR A WINDOW BLIND

CROSS-REFERENCE TO RELATED APPLICATION

This application claims priority of Taiwanese Patent Application No. 105143151, filed on Dec. 26, 2016.

FIELD

The disclosure relates to a control apparatus for a window blind, and more particularly to a control apparatus for controlling rotation of a shaft of a window blind.

BACKGROUND

A conventional safety window blind is designed to have a pulling cord looped on and rotating a rotary member for rolling a curtain. When an excess downward pulling force is applied to the pulling cord in case a child is accidentally entangled by the cord, the rotary member is drawn downward and the pulling cord is disengaged therefrom to quickly release the child. Referring to FIGS. 1 and 2, a safety control device as disclosed in WO 2015/174827 includes a housing 91, a roller 92 disposed within the housing 91, a slider 93 disposed between a rear side wall of the housing 91 and the roller 92 and biased forwardly by a spring 94 to urge the roller 92 forwardly to press against a support member 95, and a pulling cord 96 looped on the roller 92 to be pulled to rotate the roller 92 so as to transmit a torque to rotate a shaft 97 through the support member 95 for rolling a curtain. Once an excess downward pulling force is applied to the cord 96, the roller 92 is drawn out of the housing 91 and the cord 96 is disengaged from the roller 92 so as to prevent children from accidental strangulation.

Since the roller 92 is supported resiliently by the support member 95 and the slider 93 at front and rear sides with the resilient force of the spring 94, and since both the support member 95 and the slider 93 are movable in a front-and-rear direction relative to the housing 91, a tolerance connection between the housing 91 and each of the support member 95 and the slider 93 is required, which results in unsteady engagement between the roller 92 and each of the support member 95 and the slider 93, thus adversely affecting the transmission of the torque and the control of the roller 92.

Other safety control apparatus for a window blind, such as that disclosed in EP 1319793, U.S. Pat. No. 8,336,598, US 2011/0048657 or US 2012/0017399, suffers from the aforesaid drawback as well.

SUMMARY

Therefore, an object of the disclosure is to provide a control apparatus that can alleviate at least one of the drawbacks of the prior art.

According to the disclosure, the control apparatus for controlling rotation of a shaft about an axis in a front-and-rear direction, includes a housing including front and rear housing mounts which are spaced apart from each other in the front-and-rear direction, a roller interposed between the front and rear housing mounts and releasably and rotatably connected to the rear housing mount to be rotatable relative to the housing about the axis, an endless operating cord looped on the roller to be operated to rotate the roller about the axis, and a coupling mechanism rotatably disposed between the front housing mount and the roller. The coupling mechanism has a front coupling member which is disposed to be coupled with and rotate the shaft, a rear coupling member which is releasably connected to the roller by a rearward resilient force along the axis to be rotated with the roller, and which is movable along the axis and non-rotatable about the axis relative to the front coupling member so as to synchronously rotate the front coupling member when being rotated through the rotation of the roller, and a resilient member which is disposed to apply the rearward resilient force to the rear coupling member. The coupling mechanism is configured such that the roller is movable relative to the housing, upon an excess downward pulling force applied to the operating cord, from a driving position, where the roller is disposed within the housing and rotated by pulling the operating cord so as to rotate the coupling mechanism and the shaft, to a releasing position, where the rear coupling member is moved forwardly toward the front coupling member against the rearward resilient force to release connection of the roller with the rear coupling member and the rear housing mount so as to permit removal of the roller from the housing.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
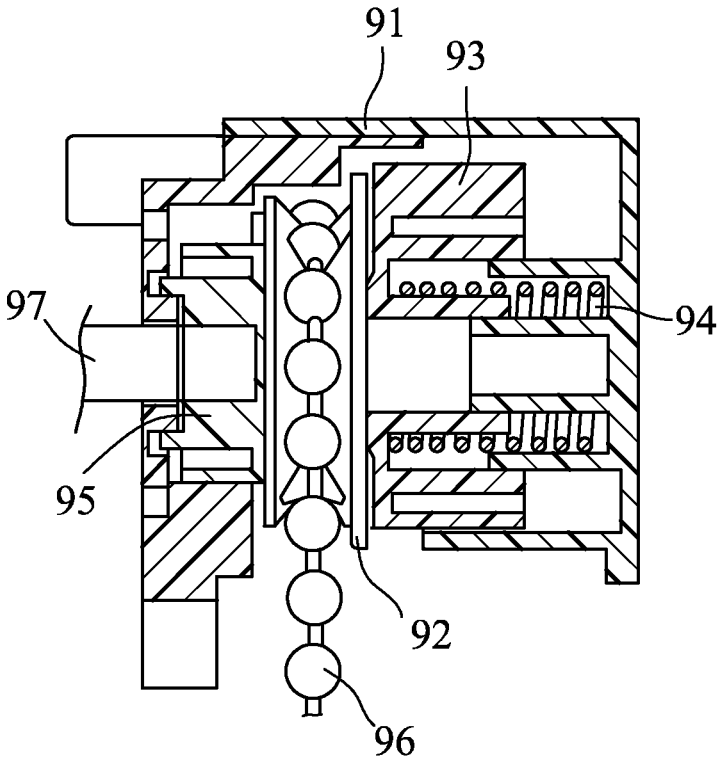
FIG.1 PRIOR ART
FIG. 1 is a fragmentary sectional view of a conventional safety control device for a roller blind in an active position.
Figure 2:
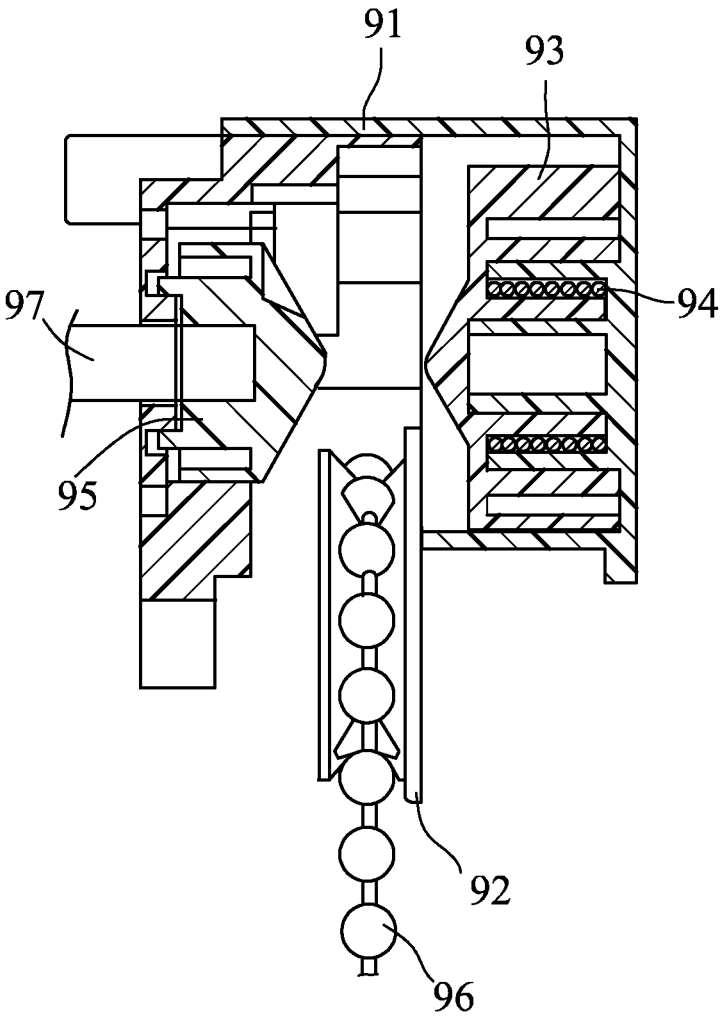
FIG.2 PRIOR ART
FIG. 2 is a fragmentary sectional view of the conventional safety control device in a state where a roller thereof is drawn out of a housing.
Figure 3:
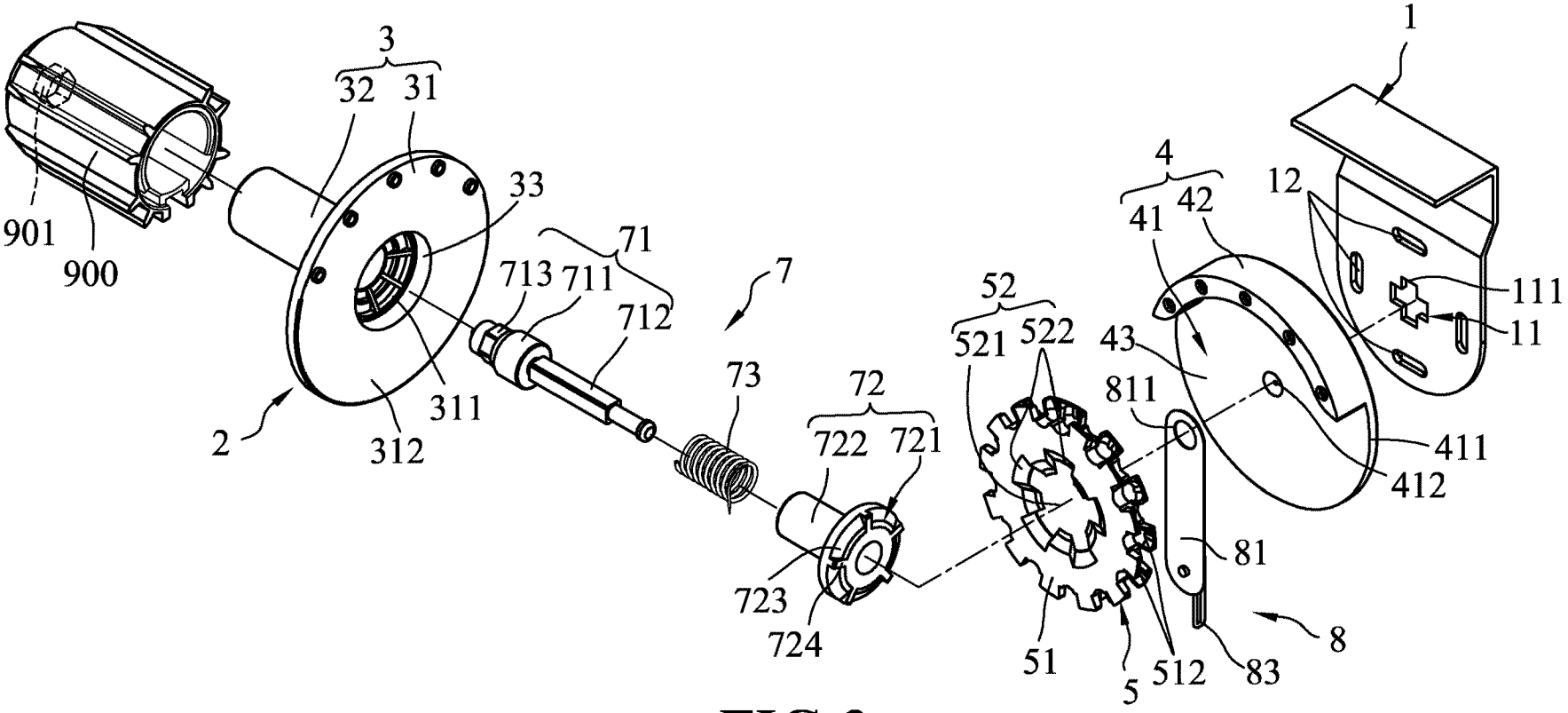
FIG. 3 is an exploded perspective view of an embodiment of a control apparatus for a window blind according to the disclosure.
Figure 4:
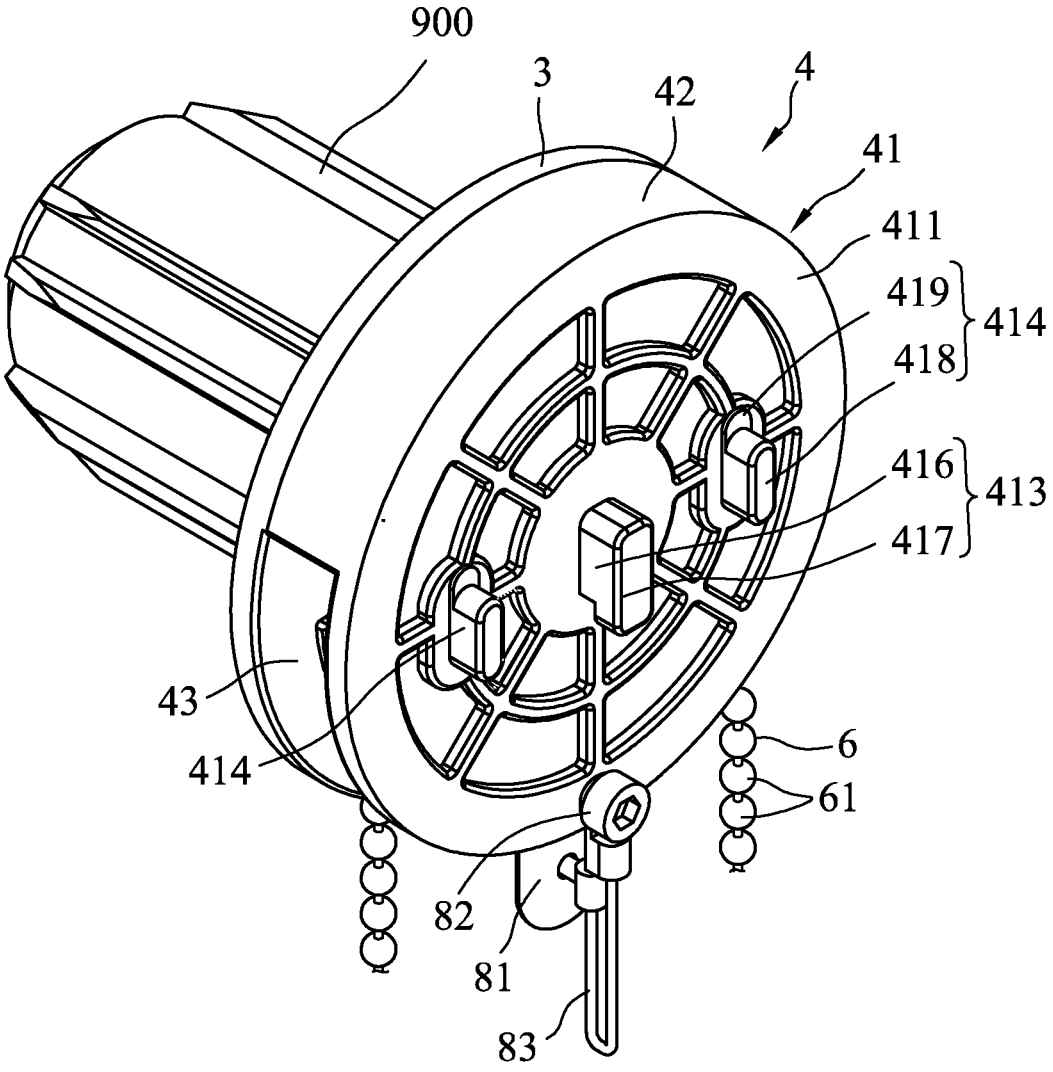
FIG. 4 is a fragmentary perspective view of the embodiment.
Figure 5:
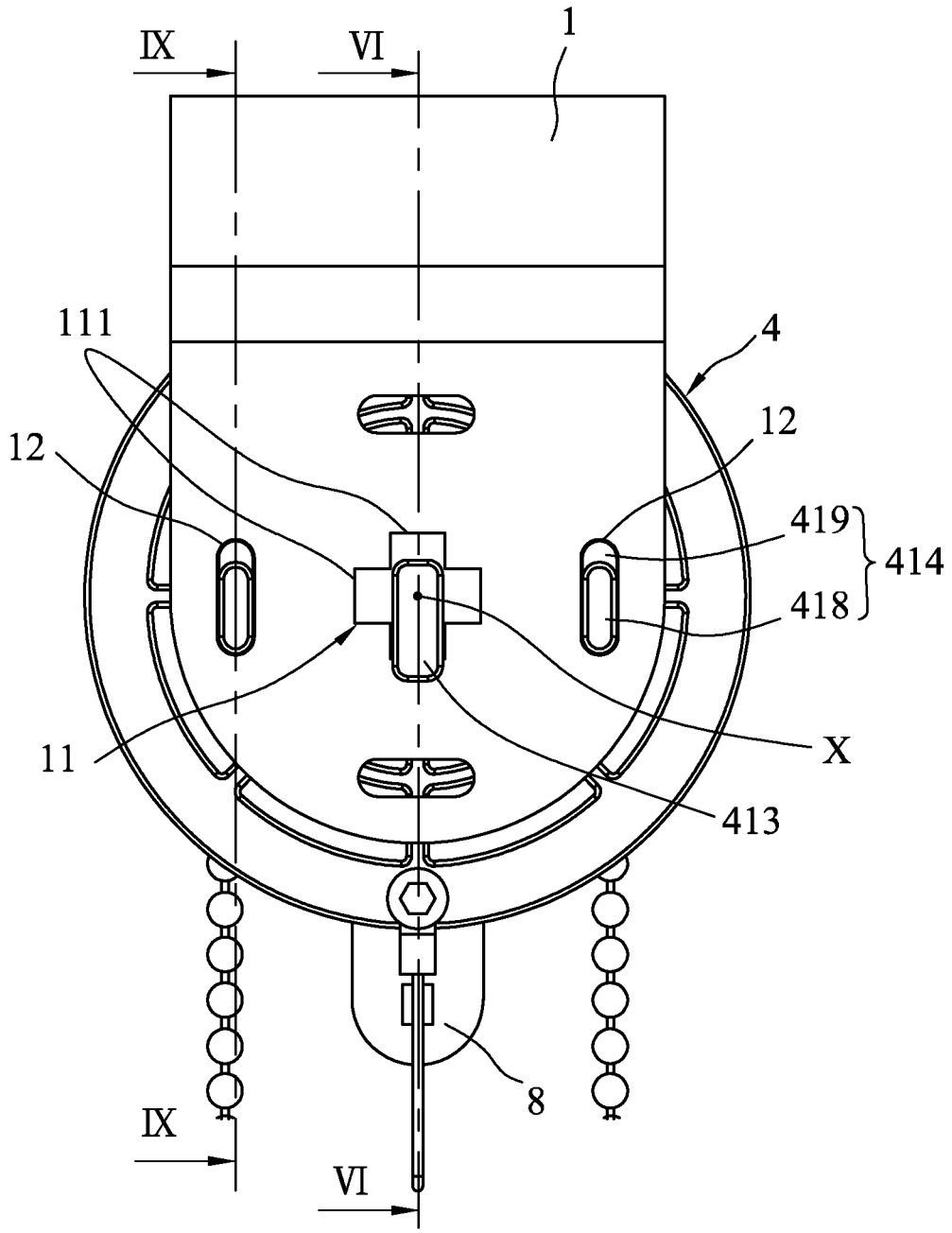
FIG. 5 is a fragmentary rear view of the embodiment, illustrating a housing secured to a mount.
Figure 6:
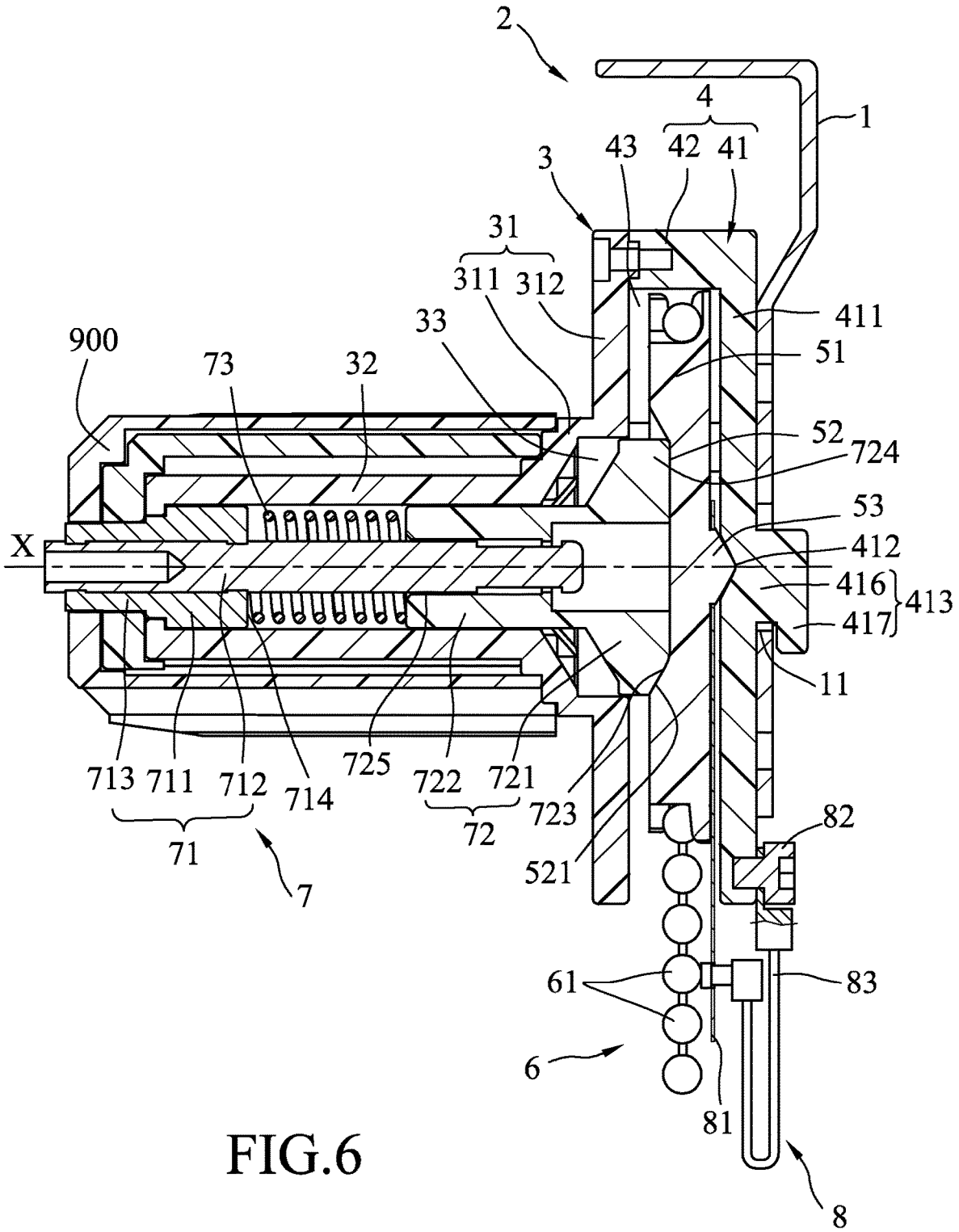
FIG. 6 is a sectional view taken along line VI-VI of FIG. 5, illustrating a state where a roller is in a driving position.

Referring to FIGS. 3, 4 and 6, an embodiment of a control apparatus is adapted to be used with a window blind, such as a roller blind, a roman blind, a venetian blind, etc., and is disposed to control rotation of a shaft 900 about an axis (X) in a front-and-rear direction for rolling a blind (not shown). The shaft 900 has a hexagonal connecting hole 901 which is connected to the control apparatus to be rotated therewith. The control apparatus of this embodiment includes a mount 1, a housing 2, a roller 5, an endless operating cord 6, a coupling mechanism 7 and a suspending unit 8.

The mount 1 is adapted to be screwed on a ceiling or a wall, and includes a main hole 11 and four auxiliary holes 12 surrounding the main hole 11. The main hole 11 is of a cross shape to have two elongated locking portions 111 intersecting each other. Two auxiliary holes 12 at left and right sides of the main hole 11 are elongated in an up-and-down direction, and two auxiliary holes 12 at upper and lower sides of the main hole 11 are elongated in a left-and-right direction.

The housing 2 is snap-fit to the mount 1, and includes front and rear housing mounts 3, 4 which are spaced apart from each other in the front-and-rear direction. The front housing mount 3 has a front upright wall 31 and a tubular portion 32 extending from the front upright wall 31 along the axis (X). The front upright wall 31 has a central wall portion 311 recessed forwardly from a rear wall surface to define a front mounting area 33, and a surrounding wall portion 312 surrounding the central wall portion 311.

The rear housing mount 4 has a rear upright wall 41 and a connecting wall 42 extending forwardly from an upper periphery of the rear upright wall 41 to be connected to the front upright wall 31. The rear upright wall 41, the connecting wall 42 and the surrounding wall portion 312 cooperatively confine a rear mounting area 43 opened downwardly. In this embodiment, the front and rear housing mounts 3, 4 are separately made to be assembled. The front and rear housing mounts 3, 4 may be integrally formed as a single piece.

The rear upright wall 41 is removably connected to the mount 1, and has an upright wall body 411, a recess 412 tapered rearwardly from a front surface of the upright wall body 411, a main protrusion 413 extending rearwardly from a rear surface of the upright wall body 411, and two auxiliary protrusions 414 extending rearwardly from the rear surface of the upright wall body 411 and at left and right sides of the main protrusion 413.

The main protrusion 413 has a horizontal portion 416 extending rearwardly from the upright wall body 411, and a vertical portion 417 extending downwardly from the horizontal portion 416. Each of the auxiliary protrusions 414 has a retaining portion 418 extending rearwardly from the upright wall body 411, and a step portion 419 extending upwardly from the retaining portion 418 and engaging the rear surface of the upright wall body 411.

Figure 7:
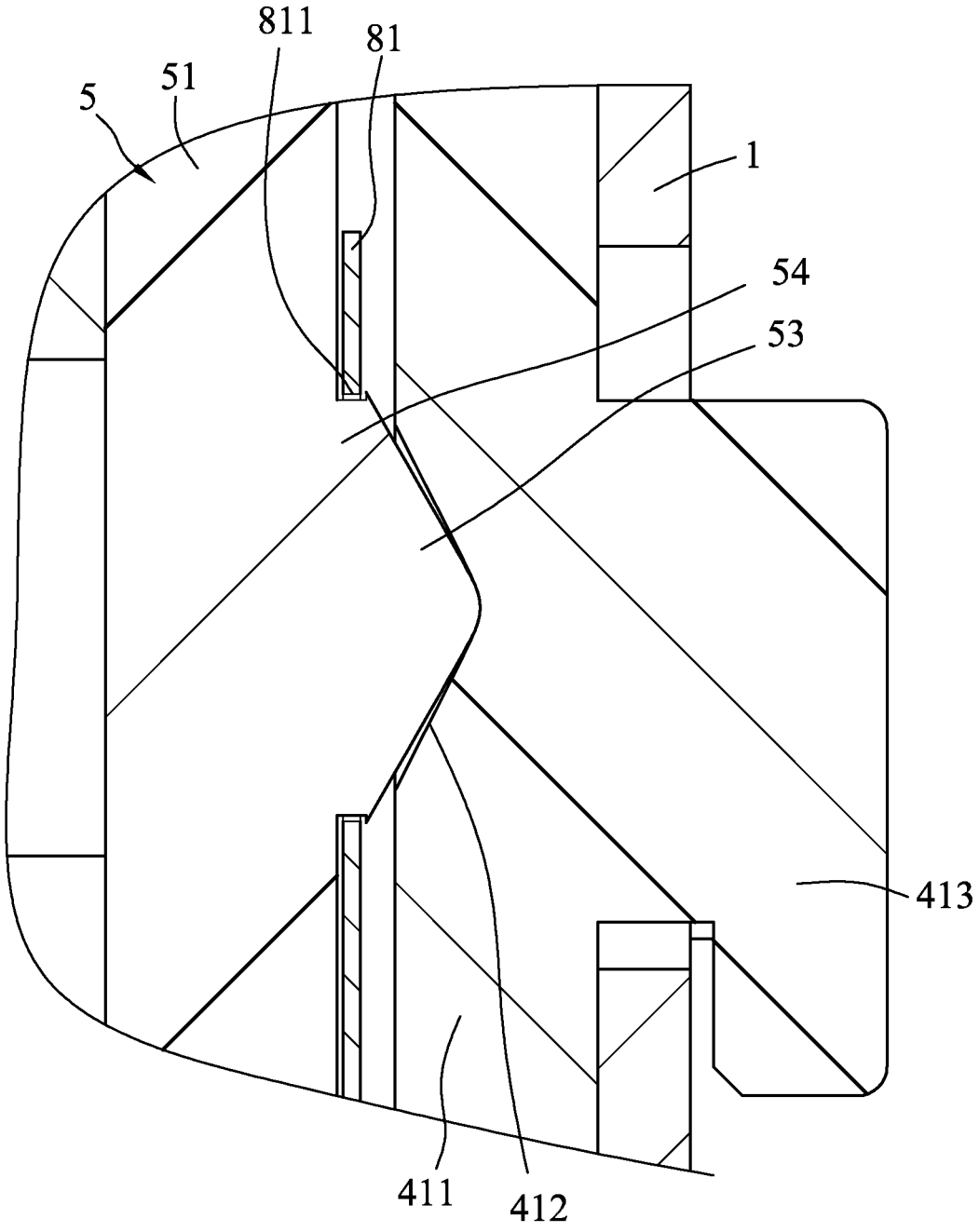
FIG. 7 is a fragmentary sectional view of the embodiment, illustrating the roller and a suspending unit connected thereto.

With reference to FIGS. 3, 6 and 7, the roller 5 is interposed between the front and rear housing mounts 3, 4, and includes an upright roller body 51 with a rim on which the operating cord 6 is mounted, a front connecting portion 52 which is disposed on a center of a front surface of the roller body 51, a rear connecting portion 53 which is disposed rearwardly of a center of a rear surface of the roller body 51 and which is tapered rearwardly, and a neck portion 54 which extends to interconnect the rear connecting portion 53 and the roller body 51. The front connecting portion 52 has a concavity 521 tapered rearwardly from the front surface of the roller body 51 and extending along the axis (X), and a plurality of indentations 522 each extending radially and outwardly from the concavity 521 and angularly displaced from each other about the axis (X). The rear connecting portion 53 is engaged in the recess 412 to establish a releasable and rotatable connection of the roller 5 to the rear housing mount 4, so that the roller 5 is rotatable relative to the housing 2 about the axis (X).

The operating cord 6 is looped on the roller 5 to be operated to rotate the roller 5 about the axis (X). In this embodiment, the cord 6 includes a plurality of beads 61 chained to one another in an endless loop. The roller body 51 has a plurality of bead grooves 512 formed in the rim and angularly displaced from one another for engagement of the beads 61 of the operating cord 6 so as to transmit a torque to rotate the roller 5.

The coupling mechanism 7 is rotatably disposed between the front housing mount 3 and the roller 5, and includes a front coupling member 71 which is disposed to be coupled with and rotate the shaft 900 and which is rotatably disposed in the tubular portion 32, a rear coupling member 72 which is disposed in the tubular portion 32 and slidable in the front-and-rear direction, and a resilient member 73 which is disposed in the front housing mount 3 and between the front and rear coupling members 71, 72. Specifically, the front coupling member 71 has an enlarged portion 711 abutting against a front end inner wall of the tubular portion 32, a stem portion 712 extending rearwardly from the enlarged portion 711 to define a shoulder abutment 714 therebetween, and a head portion 713 extending forwardly from the enlarged portion 711 to be engaged in the connecting hole 901 of the shaft 900. The stem portion 712 has a non-circular cross-section, such as a square shape.

The rear coupling member 72 has a rear connecting section 721 disposed in the rear mounting area 43, and a front connecting section 722 which extends forwardly from the rear connecting section 721 and which is coaxially and slidably connected to the stem portion 712 to rotate and be slidable relative to the front coupling member 71. The rear connecting section 721 has a retained protrusion 723 which is tapered rearwardly along the axis (X) to be retained in the concavity 521 of the front connecting portion 52, and a plurality of driven protrusions 724 each of which extends radially and outwardly from the retained protrusion 723 to be retained in a respective one of the indentations 522. Through the retention of the driven protrusions 724 in the respective indentations 522, the rear coupling member 72 is synchronously rotated with the roller 5.

The front connecting section 722 has a tubular hole 725 which extends rearwardly from a front end face thereof and which has a square cross-section in this embodiment to permit fitting and synchronously rotatable engagement with the stem portion 712. Alternatively, the tubular hole 725 may have other non-circular cross-section, such as triangular, pentagonal, hexagonal, oval, etc. The resilient member 73 is a compression spring which is sleeved around the stem portion 712 and which has two ends abutting against the shoulder abutment 714 and the front end face of the front connecting section 722 to apply a rearward resilient force along the axis (X) to the rear coupling member 72 relative to the front coupling member 71. The resilient member 73 may be made from rubber.

The head portion 713 is hexagonal in cross-section and is engaged with the connecting hole 901 to transmit a torque thereto. The head portion 713 and the connecting hole 901 may be triangular, square, pentagonal or oval in cross-section.

The suspending unit 8 includes a holding member 81 which is pivotably connected to the neck portion 54 to be disposed between the rear connecting portion 53 and the roller body 51, and a rope 83 which is connected between the holding member 81 and the rear housing mount 4 through a fastener 82. In this embodiment, the holding member 81 is a flat plate, and has a circular pivot hole 811 dimensioned to be pivotably retained on the neck portion 54 and between the rear connecting portion 53 and the roller body 51.

Figure 8:
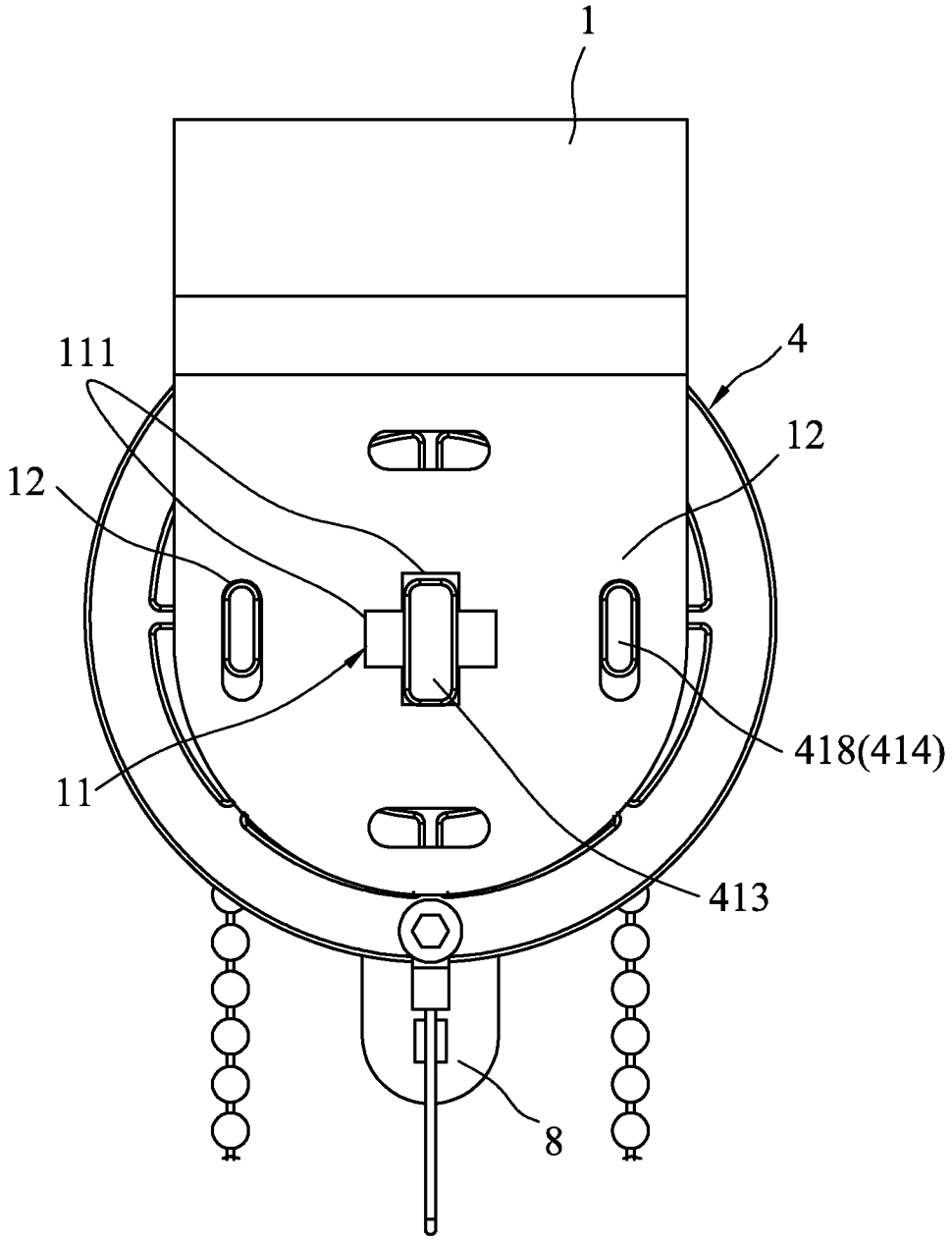
FIG. 8 is a rear view of the embodiment, illustrating a state where the housing is retainingly engaged with the mount.
Figure 9:
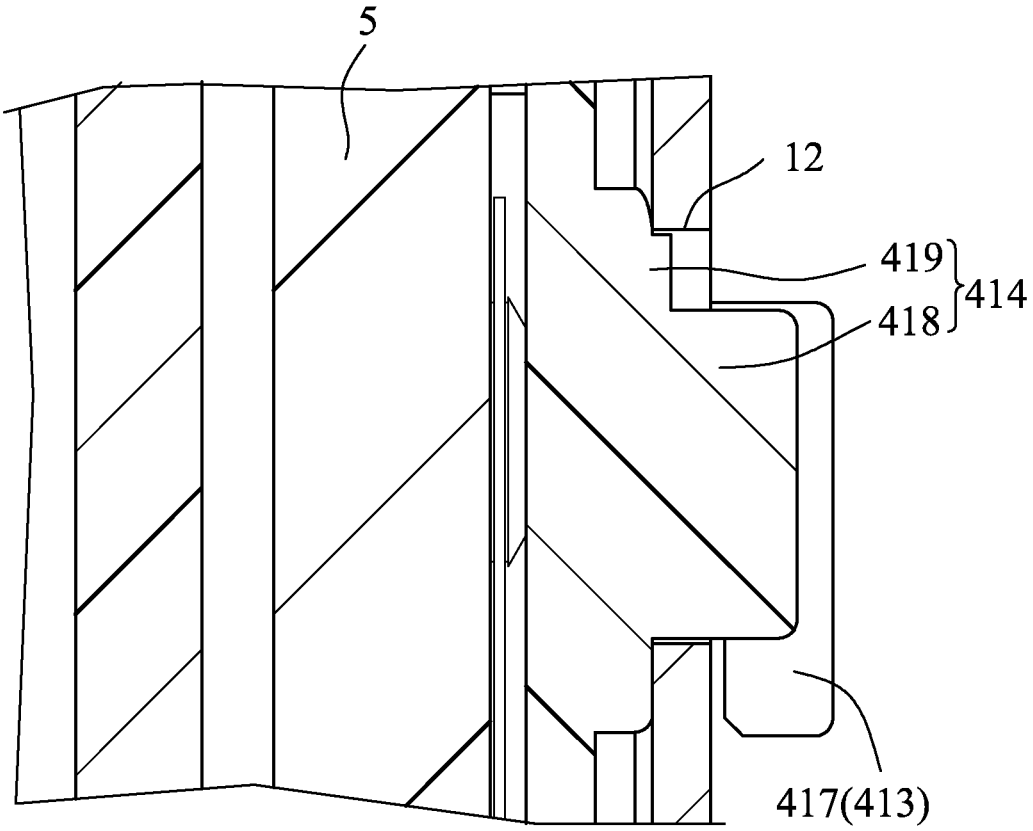
FIG. 9 is a fragmentary sectional view taken along line IX-IX of FIG. 5, illustrating an auxiliary protrusion fit in an auxiliary slot.

With reference to FIGS. 5, 6, 8 and 9, during assembly of the control apparatus, the housing 2 is secured on the mount 1 that is screwed on a ceiling through the main and auxiliary protrusions 413, 414. Firstly, as shown in FIGS. 8 and 9, the main protrusion 413 and the retaining portions 418 of the auxiliary protrusions 414 are respectively engaged in the main and auxiliary holes 11, 12 to have the step portions 419 abut against the mount 1. The housing 2 is then moved downwardly to the state shown in FIG. 5 such that the vertical portion 417 is retained on a lower edge of the main hole 11 (as shown in FIG. 6) to prevent movement of the control apparatus in the front-and-rear direction, and that the step portions 419 respectively abut against upper edges of the auxiliary holes 12 (as shown in FIG. 9) to prevent movement of the control apparatus in the up-and-down direction. Thus, the housing 2 is firmly secured to the mount 1. The main protrusion 413 may also have a step portion to be retained on an upper edge of the locking portion 111 of the main hole 11 to provide firmer retention of the housing 2.

Moreover, by means of the main and auxiliary holes 11, 12, the mount 1 may be rotated about the axis (X) by 90 degrees for being secured on an upright wall, which facilitates assembly of the window blind at different locations.

Referring to FIGS. 3, 6, 10 and 11, in use, by pulling the operating cord 6, the roller 5 and the coupling mechanism 7 are rotated synchronously to rotate the shaft 900 for rolling a curtain. Upon an excess downward pulling force applied to the operating cord 6, the roller 5 is moved relative to the housing 2 from a driving position (see FIG. 6), where the roller 5 is disposed within the housing 2, to a releasing position (see FIG. 11). Specifically, in the driving position, the roller 5 is sandwiched between the rear coupling member 72 and the rear housing mount 4 such that the rear connecting portion 53 is releasably and rotatably connected with the recess 412, and that the front connecting portion 52 is in synchronously rotatable connection with the coupling mechanism 7 to establish the releasable and synchronously rotatable connection of the roller 5 to the rear coupling member 72. Hence, when a user pulls the operating cord 6, the roller 5 is rotated about the axis (X) to drive rotation of the coupling mechanism 7 so as to rotate the shaft 900 for rolling the curtain.

Figure 10:
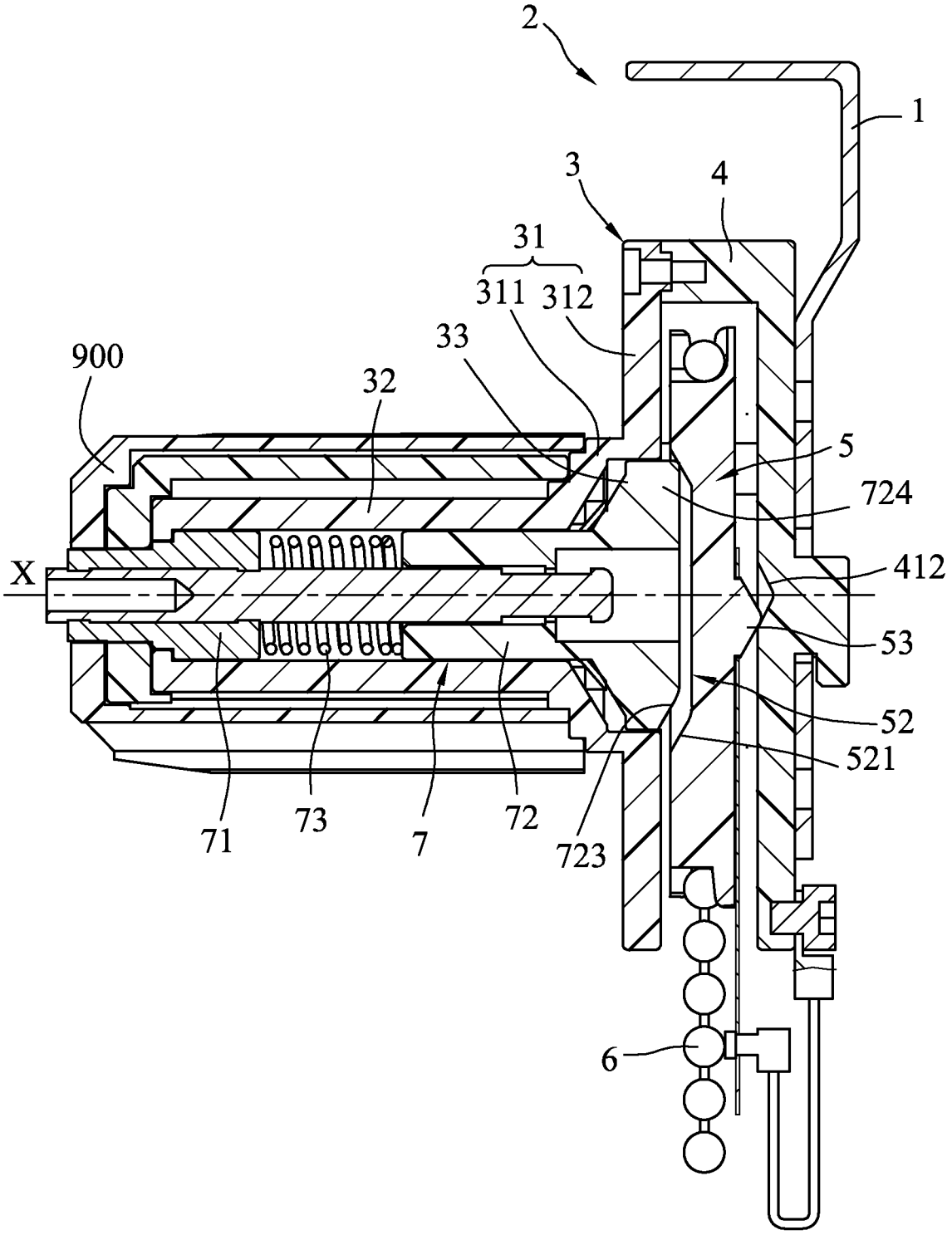
FIG. 10 is a view similar to FIG. 6, illustrating a state when the roller is pulled downwardly.
Figure 11:
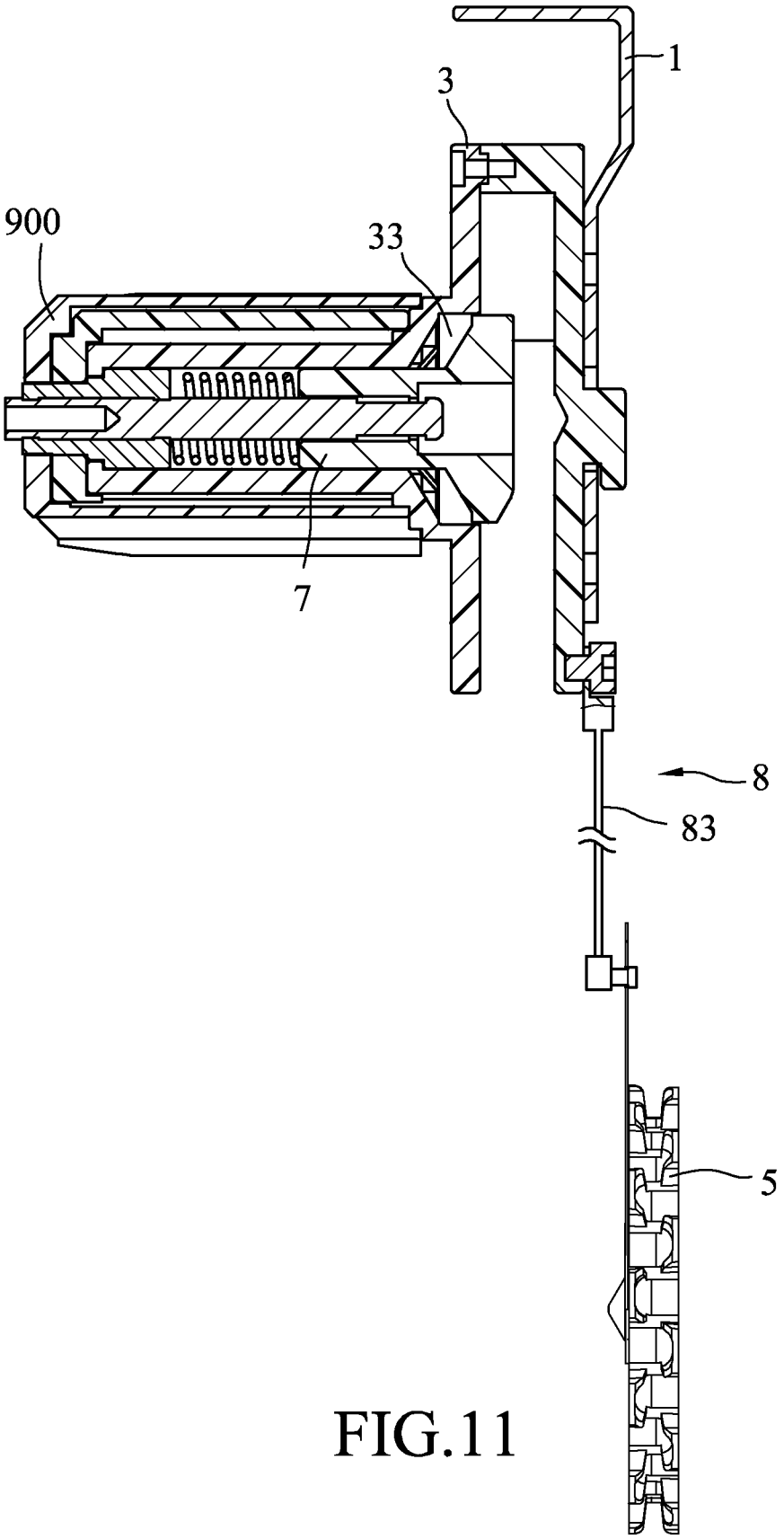
FIG. 11 is a view similar to FIG. 10, illustrating a state where the roller is in a releasing position.

Once an excess downward pulling force is applied to the cord 6, such as if a kid plays with the cord 6 and gets entangled in the cord 6 accidentally, the roller 5 is pulled downward as shown in FIG. 10 such that the rear coupling member 72 is moved forwardly toward the front coupling member 71 against the rearward resilient force of the resilient member 73 to release connection of the roller 5 with the rear coupling member 72 and the rear housing mount 4, so as to permit removal of the roller 5 from the housing 2. Forward movement of the rear coupling member 72 results in a residence for facilitating downward movement of the roller 5 and the cord 6 to be removed from the housing 2. Thereafter, the roller 5 can be suspended by the suspending unit 8 under the housing 2 to prevent injury to the kid. The cord 6 falls down to release the kid from entanglement. The rope 83 of the suspending unit 8 is designed to have an appropriate length to hold the fallen roller 5 and to keep the fallen roller 5 suspended.

With such construction of the above embodiment, in the driving position, the roller 5 is supported at a front side by the coupling mechanism 7 which is a moving member, and at a rear side by the rear housing mount 4 which is a fixed member. Thus, the roller 5 and the coupling mechanism 7 can be rotated steadily and firmly and is not affected by the pulling force of the cord 6. With engagement of the recess 412 of the rear housing mount 4 with the rear connecting portion 53 of the roller 5, the roller 5 can be easily assembled to the rear housing mount 4 without the need to have any tolerance therebetween, which prevents wobbling of the roller 5 relative to the rear housing mount 4.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A control apparatus for controlling rotation of a shaft about an axis in a front-and-rear direction, comprising:

a housing including front and rear housing mounts which are spaced apart from each other in the front-and-rear direction, said front housing mount having a tubular portion extending along the axis, said rear housing mount having a recess tapered rearwardly from a front surface thereof;

a roller interposed between said front and rear housing mounts and releasably and rotatably connected to said rear housing mount to be rotatable relative to said housing about the axis, said roller having a roller body with a rim, a front connecting portion which is disposed on a front surface of said roller body, and a rear connecting portion which is disposed rearwardly of a rear surface of said roller body and which is tapered rearwardly;

an endless operating cord looped on said rim of said roller body to be operated to rotate said roller about the axis; and a coupling mechanism rotatably disposed between said front housing mount and said roller, and having a front coupling member which is disposed in said tubular portion to be coupled with and rotate the shaft, and which has an enlarged portion and stem portion that has a non-circular cross-section and that extends rearwardly from said enlarged portion to define a shoulder abutment therebetween, a rear coupling member which is slidably mounted in said front housing mount and has a rear connecting section that is engaged with said front connecting portion of said roller, and a front connecting section that extends forwardly from said rear connecting section and that has a tubular hole extending rearwardly from a front end face thereof and configured to permit fitting and synchronously rotatable engagement with said stem portion of said front coupling member, which is releasably connected to said roller by a rearward resilient force along the axis to be rotated with said roller, and which is movable along the axis and non-rotatable about the axis relative to said front coupling member so as to synchronously rotate said front coupling member when being rotated through the rotation of said roller, and a resilient member which is mounted in said front housing mount and forwardly of said rear coupling member to abut against said rear coupling member to apply the rearward resilient force;

said rear connecting portion of said roller being engaged in said recess such that said roller is movable relative to said housing, upon a downward pulling force exceeding a predetermined amount being applied to said operating cord, from a driving position, where said roller is disposed within said housing and rotated by pulling said operating cord so as to rotate said coupling mechanism and the shaft, to a releasing position, where said rear coupling member is moved forwardly toward said front coupling member against the rearward resilient force to release connection of said roller with said rear coupling member and said rear housing mount so as to permit removal of said roller from said housing.

2. The control apparatus as claimed in claim 1, wherein said resilient member is sleeved around said stem portion and has two ends abutting against said shoulder abutment and said front end face of said front connecting section.

3. The control apparatus as claimed in claim 1, wherein said front connecting portion has a concavity tapered rearwardly from said front surface of said roller body and extending along the axis, and a plurality of indentations each extending radially and outwardly from said concavity and angularly displaced from each other about the axis, said rear connecting section having a retained protrusion which is tapered rearwardly to be retained in said concavity, and a plurality of driven protrusions each of which extends radially and outwardly from said retained protrusion to be retained in a respective one of said indentations.

4. A control apparatus for controlling rotation of a shaft about an axis in a front-and-rear direction, comprising:

a housing including front and rear housing mounts which are spaced apart from each other in the front-and-rear direction, said rear housing mount having a recess tapered rearwardly from a front surface thereof;

a roller interposed between said front and rear housing mounts and releasably and rotatably connected to said rear housing mount to be rotatable relative to said housing about the axis, said roller having a roller body with a rim, and a rear connecting portion which is disposed rearwardly of a rear surface of said roller body and which is tapered rearwardly;

an endless operating cord looped on said rim of said roller body to be operated to rotate said roller about the axis;

a coupling mechanism rotatably disposed between said front housing mount and said roller, and having a front coupling member which is disposed to be coupled with and rotate the shaft, a rear coupling member, which is releasably connected to said roller by a rearward resilient force along the axis to be rotated with said roller, and which is movable along the axis and non-rotatable about the axis relative to said front coupling member so as to synchronously rotate said front coupling member when being rotated through the rotation of said roller, and a resilient member which is disposed to apply the rearward resilient force to said rear coupling member;

said rear connecting portion of said roller being engaged in said recess such that said roller is movable relative to said housing, upon a downward pulling force exceeding a predetermined amount being applied to said operating cord, from a driving position, where said roller is disposed within said housing and rotated by pulling said operating cord so as to rotate said coupling mechanism and the shaft, to a releasing position, where said rear coupling member is moved forwardly toward said front coupling member against the rearward resilient force to release connection of said roller with said rear coupling member and said rear housing mount so as to permit removal of said roller from said housing; and a suspending unit which is connected between said housing and said roller to hold and suspend said roller under said housing when said roller is removed from said housing in the releasing position.

5. The control apparatus as claimed in claim 4, wherein said roller further has a neck portion which extends to interconnect said rear connecting portion and said roller body, said suspending unit including a holding member which is pivotably connected to said neck portion to be disposed between said rear connecting portion and said roller body, and a rope which is connected between said holding member and said housing.

* * * * *